United States Patent [19]

Phillips, Jr.

[11] Patent Number: 4,543,741

[45] Date of Patent: Oct. 1, 1985

[54] EJECTOR AND CARTRIDGE POSITIONER FOR REVOLVERS

[76] Inventor: Jonathan W. Phillips, Jr., 1202 Cherokee Hollow Dr., Katy, Tex. 77450

[21] Appl. No.: 390,705

[22] Filed: Jun. 21, 1982

[51] Int. Cl.[4] ..... F41C 15/00
[52] U.S. Cl. ..... 42/68
[58] Field of Search ..... 42/68

[56] References Cited

U.S. PATENT DOCUMENTS

| | | | |
|---|---|---|---|
| 184,145 | 11/1876 | Cochran | 42/68 |
| 4,127,955 | 12/1978 | Curran | 42/68 |
| 4,318,239 | 3/1982 | Phillips | 42/89 |

*Primary Examiner*—Charles T. Jordan

[57] ABSTRACT

An ejecting mechanism for revolvers having a cylinder with a movable axle longitudinally mounted on the longitudinal axis of the cylinder. The axle has outwardly and upwardly inclined casing contacting arms formed of light spring material. A ratchet plate is detachably mounted on the end of the axle for revolving the cylinder of the gun.

1 Claim, 3 Drawing Figures

EJECTOR AND CARTRIDGE POSITIONER FOR REVOLVERS

BACKGROUND OF THE INVENTION

In hand guns having a revolving cylinder, ammunition of a designated caliber is used, however, different manufacturers produced shells of a like caliber but often of different lengths, having rims in the cap end of the casing of varying diameter. The ejecting mechanism for removing spent casings and for maintaining the cartridges in the cylinder in the proper position relative to the firing pin, is usually designed by the manufacturer for a single gun. The need for a gun that will accommodate all ammunition of the same caliber is apparent. It is the object of this invention to provide for such a gun.

SUMMARY OF THE INVENTION

An ejecting mechanism for revolvers having the usual cylinder and a movable axle longitudinally mounted in the longitudinal axis of the cylinder, said axle having outwardly and upwardly inclined casing contacting arms formed of a light spring material, and the extended ends of which are shaped to permit a casing rim to bear against and raise the arm, when loading from the front, and using a front loader as described in my U.S. Pat. No. 4,318,239, and as the rim of the casing passes the end of the ejector, the ejector will drop back into casing holding position, engaging the rim of the casing, and when loading from the rear of the gun, the rim of the casing will be engaged by the end of the ejector and held in firing position, and in either instance, when the casings are spent or it is desired to unload the gun, the ejector may be actuated in the usual manner and the casings discharged from the cylinder. A ratchet plate is detachably mounted on the end of the axle, and provides means for revolving the cylinder in the gun in the usual manner.

DESCRIPTION OF THE PREFERRED EMBODIMENT

Figure 1:
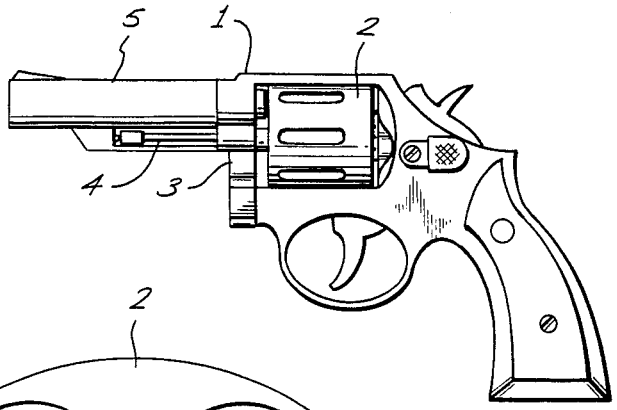
FIG. 1 is a side elevational view of a gun.
Figure 2:
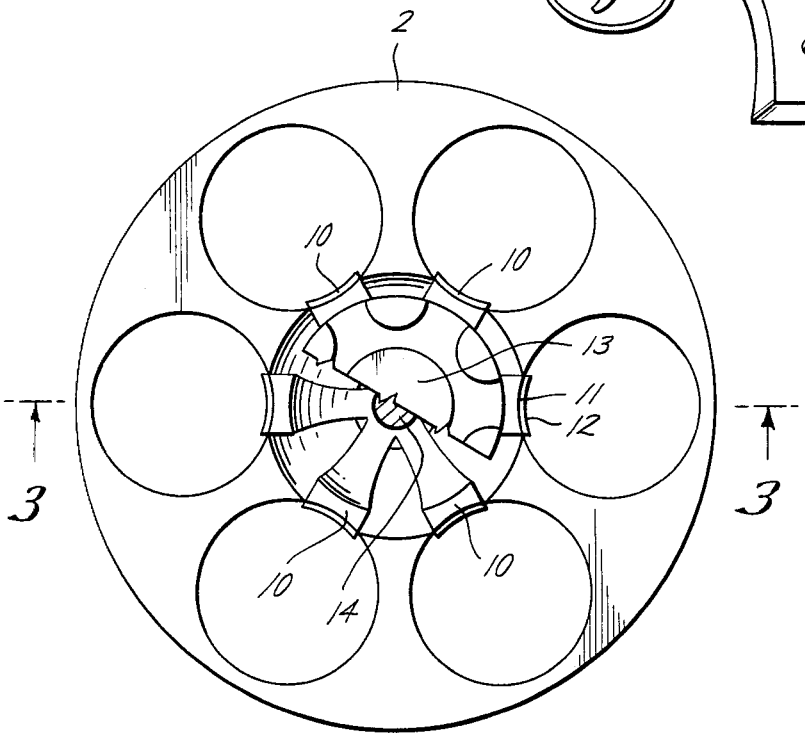
FIG. 2 is an enlarged end view of the cylinder, with the ratchet plate partially broken away.
Figure 3:
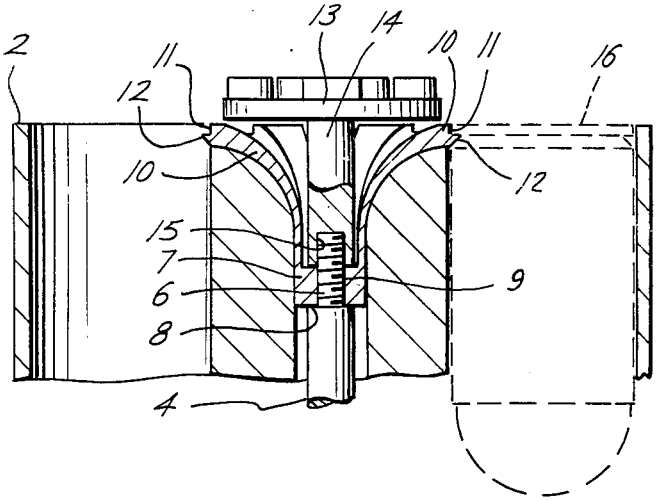
FIG. 3 is a cross-sectional view taken on the line 3—3 of FIG. 2, showing a cartridge in dotted lines in the middle of a cylinder bore.

In the drawings, the numeral 1 designates a gun frame in which the cylinder 2 is mounted on the crane 3 to be swung outwardly for loading and unloading, in the usual manner. An ejector rod 4 extend through the longitudinal axis of the cylinder 2, and extends along the bottom of the barrel 5, also in the usual manner, and is spring loaded to maintain the rod normally in retracted position, also customary for revolvers of all makes, and has one end reduced and externally threaded, as at 6.

The ejector 7 is mounted on the reduced portion, having a port 9 in one end to receive said reduced portion, and seats against the shoulder 8 with the threaded area 6 of the rod 4 extending through said port 9. Extending upwardly and inclined outwardly are the ejector arms 10 formed of spring material and each being transversely concave at the extended ends and having a notch 11 formed in the extended end and having the area beneath the notch 11 tapered upwardly and outwardly as 12.

Mounted on the end of the threaded portion 6 of the rod 4 is the ratchet plate stem 14, which is internally threaded at 15 and a ratchet plate 13 is fixedly mounted on the other end, and adapted to be engaged by the revolving mechanism of the gun (not shown) in the usual manner.

When the plate 13 is mounted on the rod 4, there will remain a space between the plate and the extended ends of the ejector arms 10, so that the rim of a casing being loaded from the front is inserted into a bore of the cylinder and will bear against the extended end of the ejector arm. As the rim bears against the tapered end 12 of the ejector arm 10, the arm 10 yields upwardly and inwardly and the rim moves past the end of said arm and permits the end of the arm 10 to drop back into its original position so that the notch 11 will engage the rim of the casing holding the casing in position for firing. When loading from the rear, the arm 10 will yield inwardly and upwardly to permit the casing to enter the cylinder bore until notch 11 engages the casing rim and the end of the arm extends into the casing groove. All casings have the peripheral groove 16. The distance of travel of the ejector arms 10 as a casing is inserted in a cylinder bore, will permit the engagement of any casing of the designated caliber, so that either rim or rimless cartridges may be loaded in the cylinder, the ejector arm holding each cartridge in the desired position with relation to the firing pin of the gun, regardless of the length of the casing or the projectile.

I claim:

1. In a casing ejector for revolvers, a cartridge cylinder having a spring loaded longitudinal axle forming an ejector rod which is movable longitudinally of the cylinder, one end of said rod being diametrically reduced, ejector arms mounted on said diametrically reduced end of said rod, said arms being yieldable and upwardly and outwardly inclined, the extended ends of each arm having casing engaging means to maintain a cartridge casing in firing position in said cylinder when said rod is in one position, and for ejecting said casing upon longitudinal movement of said rod to another position, said casing ejector consisting of a cylindrical member having an axial port extending longitudinally therethrough and through which one end of said rod extends, a ratchet plate mounted on the diametrically reduced end of said rod adjacent to said arms, limiting the outward movement thereof.

* * * * *